US006739322B2

(12) United States Patent
Rice et al.

(10) Patent No.: US 6,739,322 B2
(45) Date of Patent: May 25, 2004

(54) PAINTBALL FEED SYSTEM

(75) Inventors: John Ronald Rice, Stafford (GB); Nicholas John Marks, Staffordshire (GB); Fraser Colley, Wolverhampton (GB)

(73) Assignee: NPF Limited (GB)

( * ) Notice: Subject to any disclaimer, the term of this patent is extended or adjusted under 35 U.S.C. 154(b) by 0 days.

(21) Appl. No.: 10/248,395

(22) Filed: Jan. 15, 2003

(65) Prior Publication Data

US 2003/0131835 A1 Jul. 17, 2003

(30) Foreign Application Priority Data

Jan. 15, 2002 (GB) ..... 0200812

(51) Int. Cl.[7] ..... F41B 11/02
(52) U.S. Cl. ..... 124/49
(58) Field of Search ..... 124/49, 50, 73; 285/346, 351, 353, 354

(56) References Cited

U.S. PATENT DOCUMENTS 2,190,419 A * 2/1940 Evarts
2,258,941 A * 10/1941 Wayman
6,418,919 B1 * 7/2002 Perrone
6,588,412 B2 * 7/2003 Ferrara et al.
6,591,824 B2 * 7/2003 Hatcher

* cited by examiner

*Primary Examiner*—John A. Ricci
(74) *Attorney, Agent, or Firm*—Vedder Price Kaufman & Kammholz, P.C.; Robert S. Beiser, Esq.

(57) ABSTRACT

A paintball feed system (10) comprises flexible detent beams **(32*a,b*) that flex about first and second support points (33,34) such that they allow a paintball (22*a*) to pass from a hopper (18) into a feed tube (12) leading to a paintball marker's breech (16) under it's own weight when flexing about the first support point (33). The beams (32*a,b*) are rigid enough, when flexing about the second support pint (34), to prevent the return of the paintball (22*a*) back into the hopper (18) from the feed tube (12)**.

35 Claims, 8 Drawing Sheets

PAINTBALL FEED SYSTEM

BACKGROUND OF INVENTION

This invention relates to a paintball feed system. More particularly, but not exclusively it relates to a paintball feed system that is arranged to allow a paintball to pass into a breech of a paintball marker and is arranged to prevent the passage of the paintball out of the breech of the marker.

Referring to FIG. 1, it is currently known to feed a paintball (1) into a breech (2) of a paintball marker (3) from a hopper (4) under gravity. This arrangement has the inherent problem that, should the marker (3) be tilted out of a horizontal plane or jolted, the paintball (1) in the breech (2) can pass out of the breech (2) back towards the hopper (4). If the marker is fired while the paintball (1) is not resting on the bottom of the breech (2), "chopping" of the paintball (1) can result whereby the bolt (not shown in FIG. 1) splits the paintball (1) because it cannot be propelled along the breech (2). Chopped paintballs can foul the marker's firing mechanism leading to impaired performance and even possibly jamming of the marker. Importantly for paintball players, if no paintballs are present in the breech, due to the marker being tilted or jolted or for any other reason, the marker will not fire which can seriously affect the player's game.

A hopper exists, as shown in FIG. 2, that employs a beam strain gauge (5) the main purpose of which is to count paintballs as they are used. The strain gauge (5) is secondarily used in an attempt to allow only one way flow of paintballs. This arrangement does however suffer from the problem that it does not allow a paintball (1) to fall freely under its own weight. A stack of paintballs (1) must weigh down on the beam strain gauge (5) in order to allow a paintball (1) to pass from the hopper (4) into the breech (2). This can result in the last few paintballs (1) in a hopper (4) not being used. Additionally, due to a lack of rigidity of the strain gauge (5) in the return direction the strain gauge's return prevention is poor. Thus this arrangement is poor at retaining the paintballs (1) in the breech (2). This allows the movement of the paintballs out of the breech (2) and consequently the possibility of chopping the paintballs (1).

Thus existing marker feed systems have the problem that chopping can occur due to the paintballs in a feed tube being able to jiggle in the free space in the feed tube and present a fraction of themselves to the marker's bolt.

SUMMARY OF INVENTION

According to a first aspect of the present invention there is provided a paintball feed system for a paintball marker, the system comprising means defining a feed channel through which paintballs can pass into the marker, flexible detent means arranged to deflect to allow paintballs to pass in a first direction through the channel into the marker, and being further arranged to prevent the passage of the paintballs in a second direction through the channel out of the marker.

Preferably the system comprises support means which define first and second support points from which the detent means is arranged to flex in the first and second directions respectively. More preferably the detent means has a free end and the second support point is closer to the free end than the first support point.

The detent means preferably comprises a flexible beam, which preferably has a cross-sectional area which varies along its length. The beam may have a base and a free end and the cross sectional area may increase towards the free end. Preferably the beam has a narrow portion towards the base and a broad head portion towards the free end.

Preferably the detent means is arranged to be spaced from a floor of a breech of the paintball marker and the feed channel is arranged to receive a plurality of paintballs including an uppermost paintball which is in contact with the detent means and a lowermost paintball which is in contact with the floor of the breech whereby vertical movement of the paintballs between the detent means and the floor is inhibited. Preferably the detent means is arranged to allow a paintball to pass in the first direction under its own weight. This helps to ensure that all available paintballs are used up.

The detent means preferably comprises a plurality of flexible beams, for example three flexible beams, which are spaced around the feed channel. This can help to centre the paintball in the feed channel. The flexible beams preferably extend radially inwards towards the centre of the feed channel, and can conveniently be formed as part of an annular shim from which they project radially inwards.

Preferably the feed system further comprises adjustment means arranged to allow adjustment of the distance between the detent means and a floor of a breech of the marker. This allows the system to be adjusted for example to correct for different sizes of paintball.

The present invention further provides a paintball marker including a paintball feed system, the feed system comprising means defining a feed channel through which paintballs can pass into the marker, flexible detent means arranged to deflect to allow paintballs to pass in a first direction through the channel into the marker, and being further arranged to prevent the passage of the paintballs in a second direction through the channel out of the marker.

The present invention further comprises a paintball marker and hopper assembly including a paintball feed system, the feed system comprising means defining a feed channel through which paintballs can pass from the hopper into the marker, flexible detent means arranged to deflect to allow paintballs to pass in a first direction through the channel from the hopper into the marker, and being further arranged to prevent the passage of the paintballs in a second direction through the channel out of the marker towards the hopper.

The present invention still further provides an adapter for connecting a paintball marker to a paintball storage device wherein the adapter includes a feed system according to the invention. The adapter may be arranged to be movable relative to at least one of the marker and the storage device in order to vary the distance between the detent means and a floor of a breech of the marker.

The present invention yet further provides a paintball feed system for a paintball marker, the system comprising a feed channel through which paintballs can pass into the marker, a flexible detent arranged to deflect to allow paintballs to pass in a first direction through the channel into the marker, and being further arranged to prevent the passage of the paintballs in a second direction through the channel out of the marker.

The present invention further provides a paintball marker feed tube assembly arranged to be mounted in a paintball marker and to support a paintball hopper having a neck, the assembly comprising a compressible member defining an aperture into which the neck can be inserted and a compression member arranged to compress the compressible member by an amount which is variable thereby to vary the size of the aperture.

The compressible member may be one of a plurality of compressible members arranged to co-operate to support the neck. For example each of the compressible members may comprise a ring of resilient material.

The assembly preferably further comprises a flexible detent arranged to deflect to allow paintballs to pass in a first direction through the assembly into the marker, and being further arranged to prevent the passage of the paintballs in a second direction through the assembly out of the marker, and a retaining member arranged to retain the detent in the assembly, wherein the compressible member rests on the retaining member.

The invention will now be described, by way of example, with reference to the accompanying drawings.

DETAILED DESCRIPTION

Figure 1A:
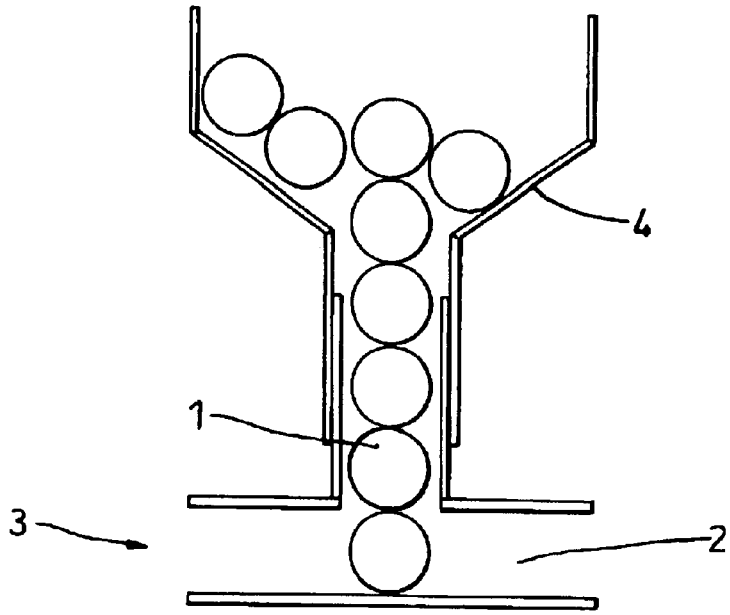
Fig. 1a (PRIOR ART)
FIG. 1*a* is a schematic view of a prior art paintball feed mechanism.
Figure 1B:
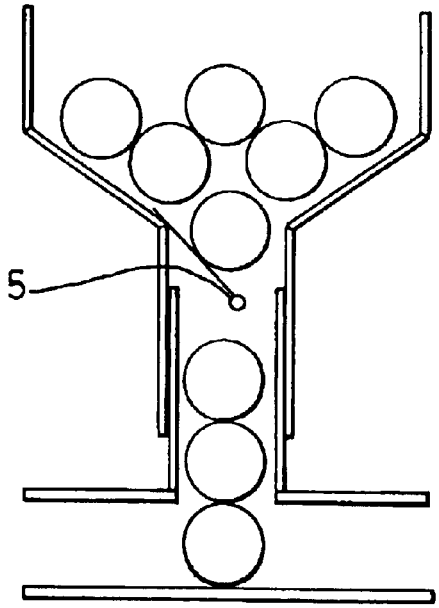
Fig 1b (PRIOR ART)
FIG. 1*b* is a schematic view of a prior art paintball hopper including a strain gauge/detent mechanism.
Figure 2:
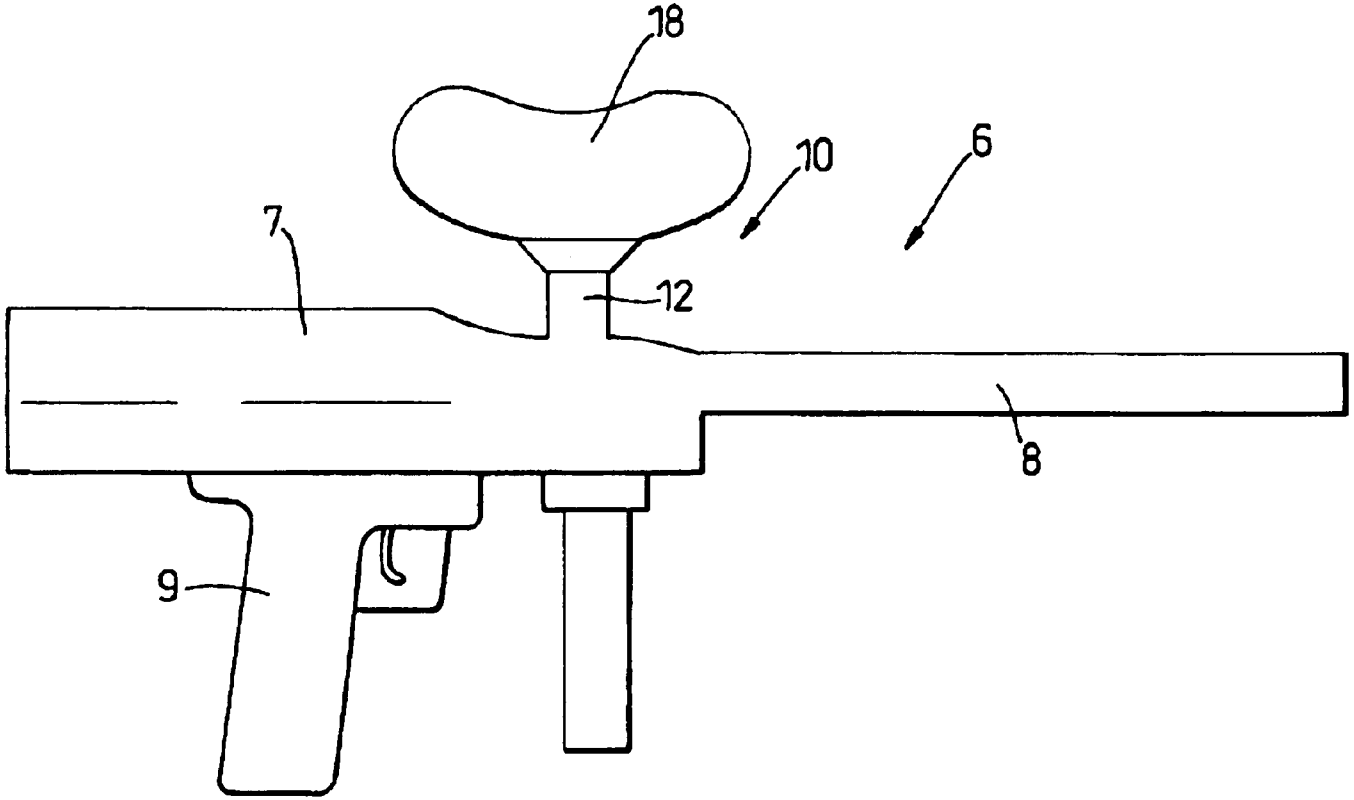
FIG. 2 is a schematic side view of a paintball marker and hopper assembly according to a first embodiment of the invention.

Referring to FIG. 2, a paintball marker or gun 6 comprises a body 7 and barrel 8, and a grip 9. A feed system 10 comprises a hollow cylindrical paintball feed tube 12 connected to the top of the body 7 and a hopper 18.

Referring now to FIGS. 3*a–d*, the feed tube 12 defines a paintball feed channel 13 which leads into a paintball marker breech 16 having a bolt 17 therein which is actuated by the marker's pneumatic firing system (not shown) to eject paintballs from the breech 16 along the barrel 8.

The feed tube 12 is typically integrally formed with the breech 16 and has a main portion 20 having an internal diameter just slightly larger than that of a paintball 22*a* and an externally threaded neck portion 24, projecting upwards from the top of the main portion 20, that has a wider internal diameter than the main portion 20.

The hopper 18 has tapered sides ending in an annular surface 26 with a circular opening 28 having a diameter just slightly larger than that of the paintball 22. An internally threaded circumferential collar 30 projects axially from the surface 26. The collar 30 is complementarily threaded to the neck portion 24 and of a suitable diameter to threadably engage therewith. Thus, the feed tube 12 and the opening 28 are substantially concentric when the collar 30 and neck portion 24 are threadably engaged.

Figure 3A:
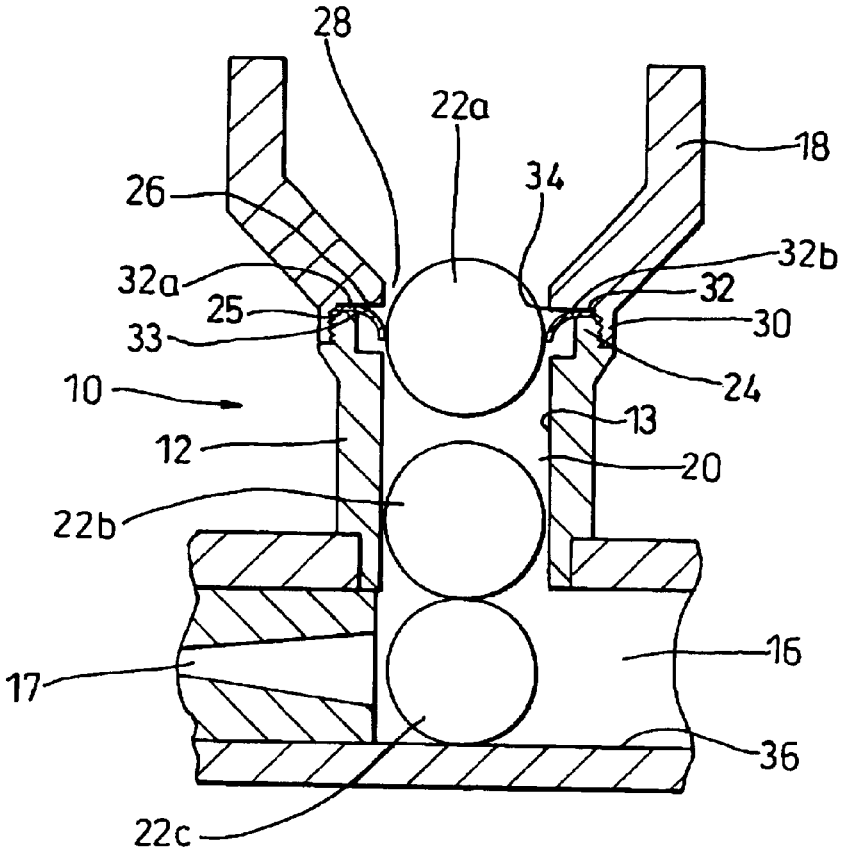
FIG. 3*a* is a schematic section through part of the assembly of FIG. 2 showing a paintball feed system according to the invention.
Figure 3B:
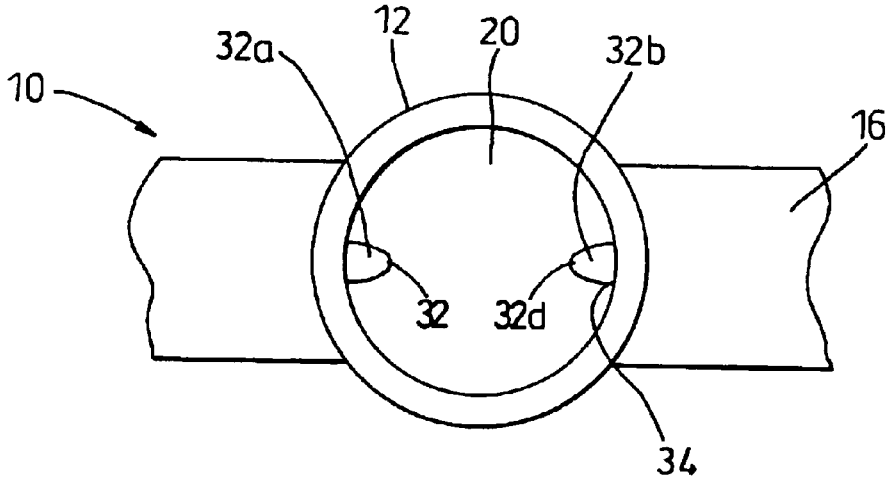
FIG. 3*b* is a schematic plan view of a feed tube of the assembly of FIG. 3*a;*
Figure 3C:
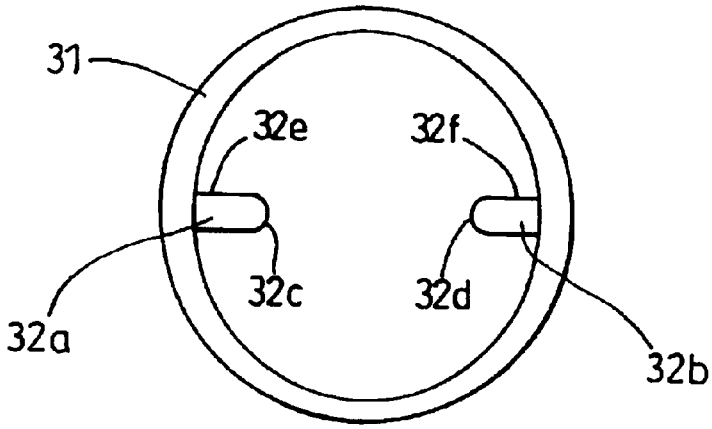
FIG. 3*c* is a plan view of a detent means of the paintball feed system of FIG. 3*a;*

An annular shims 31 shown in FIG. 3*c* has a main annular portion 32 and two flexible detent beams 32*a*, 32*b* that project radially inward from the annular portion 32. The beams 32*a*, 32*b* are diametrically opposed, and extend part way across the opening through the annular portion 32. The beams 32*a*, 32*b* each have a free end 32*c*, 32*d* which is radially innermost, and a base 32*e*, 32*f* where they are joined to the annular portion 32.

The shim 31 rests upon a free end 25 of the neck portion 24 of the feed tube 12 such that the annular portion 32 lies between the end 25 of the neck portion 24 and the surface 26. The beams 32*a*, 32*b* project radially inward into the opening 28 and extend part way across it.

Figure 3D:
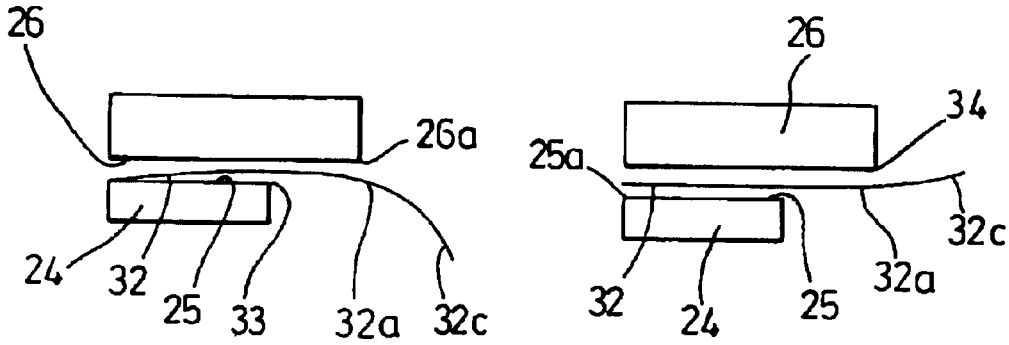
FIG. 3*d* is a schematic sectional view of a the detent means of FIG. 3*c* and support points, showing the degree of flexion available in either direction.

As shown in FIG. 3*d*, the extension of the beams 32*a*, 32*b* over the free end 25 of the neck portion 24 and the annular surface 26 provides two sets of support points 33, 34. The first support points 33 are defined at the internal edge 25*a* of the free end 25 of the neck portion 24 and the second support points 34 are defined at the internal edge 26*a* of the surface 26. If the beams 32*a*, 32*b* are deflected downwards, they flex from the first support point 33. If they are deflected upwards, they flex from the second support point 34.

The second support points 34 are further from the annular portion 32 of the shim 31, and closer to the free ends 32*c*, 32*d* of the beams 32*a*, 32*b* than are the first support points 33. Therefore the length of the beams 32*a*, 32*b* which extends inwards beyond the first support points 33 is greater than the length of the beams 32*a*, 32*b* which extends inwards beyond the second support points 34. Therefore the beams 32*a*, 32*b* are more easily flexed downwards into feed tube 12 than upwards into the opening 28.

Thus, referring back to FIG. 3*a*, as a paintball 22*a* from within the hopper 18 abuts the beams 32*a*, 32*b* they are deflected downwards into the neck portion 24 and allow the paintball 22*a* to pass from the hopper 18 into the feed tube 12 under its own weight, provided that there is sufficient space within the feed tube 12 to accommodate the paintball 22*a*.

When the hopper is filled with paintballs, a first paintball 22*c* drops down through the feed tube and comes to rest in contact with the floor 36 of the breech 16. A further paintball 22*b* then drops down on top of the first one 22*c*. Finally a third paintball 22*a* drops down and rests on top of the second one 22*b*. At his point the stack of paintballs 22*a–c* fills the feed tube 12, and the beams 32*a*, 32*b* rest against the top paintball 22*a*. The paintballs 22*a*, 22*b*, 22*c* are thereby retained within the feed tube 12 and breech 16 by the resistance to upward flexure of the beams 32*a*, 32*b* into the opening 28 about the second support points 34. Thus, the detent beams 32*a*, 32*b* allow the passage of the paintballs 22*a*, 22*b*, 22*c* from the hopper 18 into the feed tube 12 under their own weight and prevent them from passing back into the hopper 18 when the marker breech 16 is displaced from horizontal alignment.

In this embodiment the free end 25 of the neck portion 24 is spaced so that the shim 31 is just less than an integral number of paintball diameters from the floor 36 of the breech 16, in this example just less than three paintball diameters. This has the effect of maintaining the three paintballs 22*a*, 22*b*, 22*c* in the feed tube 12 in contact with each other, with the uppermost paintball 22*a* being in contact with the detent beams 32*a*, 32*b* and the lowermost paintball 22*c* being in contact with the floor 36 of the breech 16. This arrangement thereby prevents movement of the paintballs 22*a*, 22*b*, 22*c* up the tube 12 and keeps the lowermost paintball 22*c* in contact with the floor of the breech 16. The maintenance of the paintballs 22*a*, 22*b*, 22*c* in contact with each other within the feed tube 12 reduces the chances of chopping of a paintball occurring by preventing the paintballs from jiggling due to having free space in which to move. This denial of free movement limits the opportunity for only a fraction of a paintball to be projecting into the breech 16 where the bolt 17 can chop it during the firing action.

Figure 4:
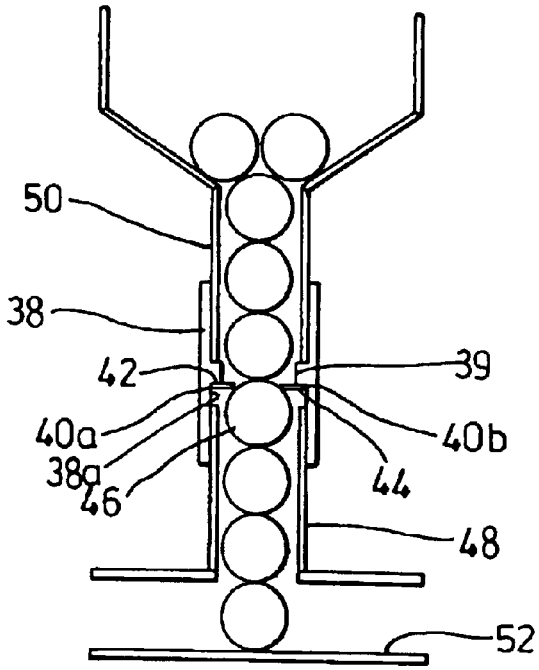
FIG. 4 is a schematic view of an adaptor arranged to connect a marker and hopper including a paintball feed system according to a second embodiment of the present invention.
Figure 4A:
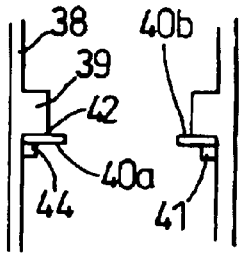

In a second embodiment of the present invention as shown in FIG. 4 and FIG. 4*a*, there is provided a cylindrical collar 38 having an internal circumferential lip 39 at its midpoint. An annular shim 40 having a pair of detent beams 40*a*, 40*b* project radially inwardly from it, is held against the lower side of the lip 39, with the beams 40*a*, 40*b* extending inwards beyond the lip 39. As shown in FIG. 4*a*, the shim 40 is held in place against the lip 39 by means of a split ring 41 (not shown in FIG. 4). The lip 39 and split ring 41 define respectively two sets of support points 42, 44 for the beams 40*a*, 40*b*, the one 42 above the beams 40*a*, 40*b* being radially further inwards than the one 44 below the beams 40*a*, 40*b*. This allows one-way passage of a paintball 46 through the collar 38. The collar 38 is arranged to receive a marker feed tube 48 in one end and a the feeder neck 49 of a hopper 50 in the other end. The collar 38 can be designed such that the beams 40*a*, 40*b* reside an integral number of paintball diameters from a of the marker's breech floor 52 provided the length of the feed tube 48 is known. This arrangement allows the retro-fitting of a feed system according to the present invention to a standard, non-modified marker.

Figure 5:
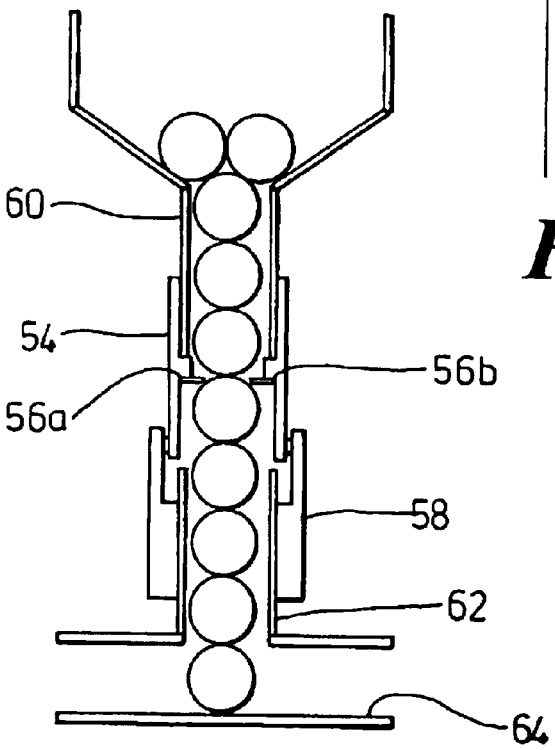
FIG. 5 is a schematic sectional view of a threaded adaptor arranged to connect a marker and hopper including a paintball feed system according to a third embodiment; of the present invention.

Alternatively, as shown in FIG. 5, an annular collar 54 is substantially similar to that described hereinbefore in relation to FIG. 4 and has a pair of detent beams 56*a*, 56*b*. The collar 54 is threadably engaged with an annular sleeve 58. The collar 54 is arranged to receive a hopper 60. The sleeve 58 is arranged to receive a marker feed tube 62. The distance between the detent beams 56*a*, 56*b* and the marker's breech floor 64 can be adjusted by screwing the collar 54 into or out of the sleeve 58, thus achieving just less than an integral number of paintball diameters between the beams 56*a*, 56*b* and the floor 64, in this example five paintball diameters.

Figure 6:
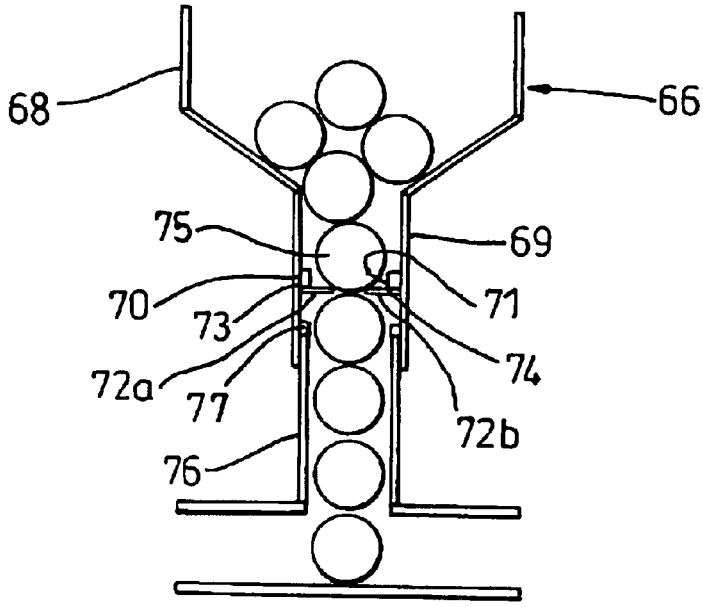
FIG. 6 is a schematic view of a paintball hopper including a paintball feed system according to a fourth embodiment of the present invention connected to a paintball marker.

In a further embodiment of the present invention as shown in FIG. 6 there is provided a paintball hopper 66 including a body 68 and a neck 69 with an tubular wall 70 with a central circular opening 71 therethrough. The neck 69 has a pair of detent beams 72*a*, 72*b* fixed at the edge and projecting radially inwardly thereof over the tubular wall 70 on an opposite side of the wall 70 to the body 68.

Thus two sets of support points 73, 74 of the beams 72*a*, 72*b* are defined at the fixing points of the beams 72*a*, 72*b* and at the edge of the opening 71, respectively. The first set of support points 73 is positioned such that the degree of flexibility of the beams 72*a*, 72*b* away from the body 68 is sufficient to allow a paintball 75 to pass from the hopper 66 under its own weight. The short length of the beams 72*a*, 72*b* from the second support points 74 results in a low degree of flexibility back towards the body 68. This prevents the passage of a paintball into the hopper 68 past the beams 72*a,b* unless a significant external force is applied. The neck 69 is arranged to receive a marker feed tube 76 and has an inwardly projecting lip 77 thereabout which the feed tube 74 abuts upon complete insertion thereinto.

Figure 7:
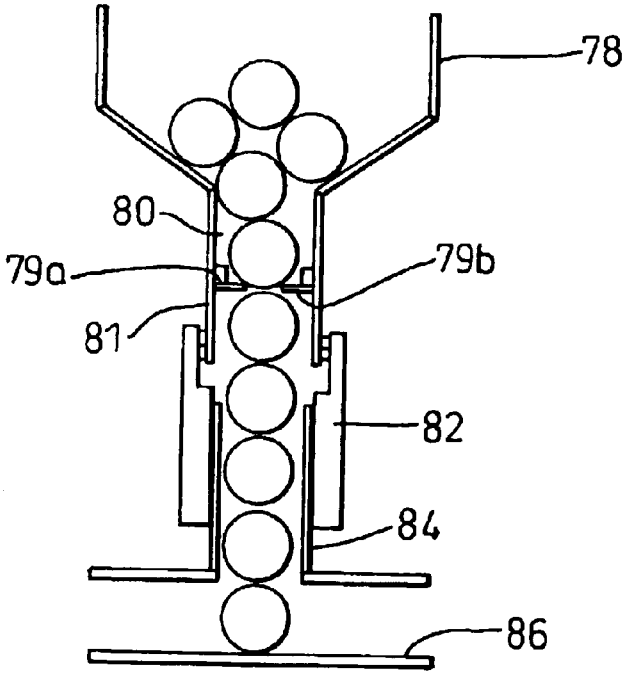
FIG. 7 is a schematic view of a paintball hopper and marker arrangement connected via an adapter, the hopper including a paintball feed system according to a fifth embodiment of the present invention.

Alternatively, as shown in FIG. 7 a hopper 78, that is substantially similar to the hopper described above in relation to FIG. 6, has detent beams 79*a*, 79*b* projecting radially inward of an exit opening 80. The neck 81 screw is threadably attached to a sleeve 82 that is arranged to receive a marker feed tube 84. The distance between the detent beams 79*a*, 79*b* and a breech floor 86 of a paintball marker 88 can be varied by screwing the neck 81 into/out of the sleeve 82 such that it is an integral number of paintball diameters in a similar manner and as described hereinbefore in relation to the annular collar 54.

Figure 8:
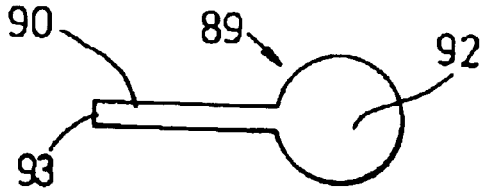
FIG. 8 is a schematic view of a detent beam of a paintball system according to a modification of the first embodiment of the present invention.

Referring now to FIG. 8, in a modification to the first embodiment described above with reference to FIGS. 2 to 3*d*, the detent beams 32*a*, 32*b* are each replaced by a detent beam 89. This detent beam 89 has a narrow elongate body 90 and a circular paddle shaped head 92 that is wider than the body 90. The end 95 of the body 90 remote from the head is fixed to the annular part 32 of the shim 31. The increased width of the head 92 in relation to the body 90 results in an increased stiffness of the head 92 compared to the body 90. The first and second support points 33, 34 are aligned with the body 90 and head 92 respectively. Therefore as well as there being a shorter length of the beam 89 extending beyond the second support point 34 than the first support point 33, the part of the beam 90 at the first support point is narrower and hence more flexible than the part 92 are the second support point. Therefore the difference in flexibility of the beam 89 in the upward and downward directions is increased.

Figure 9:
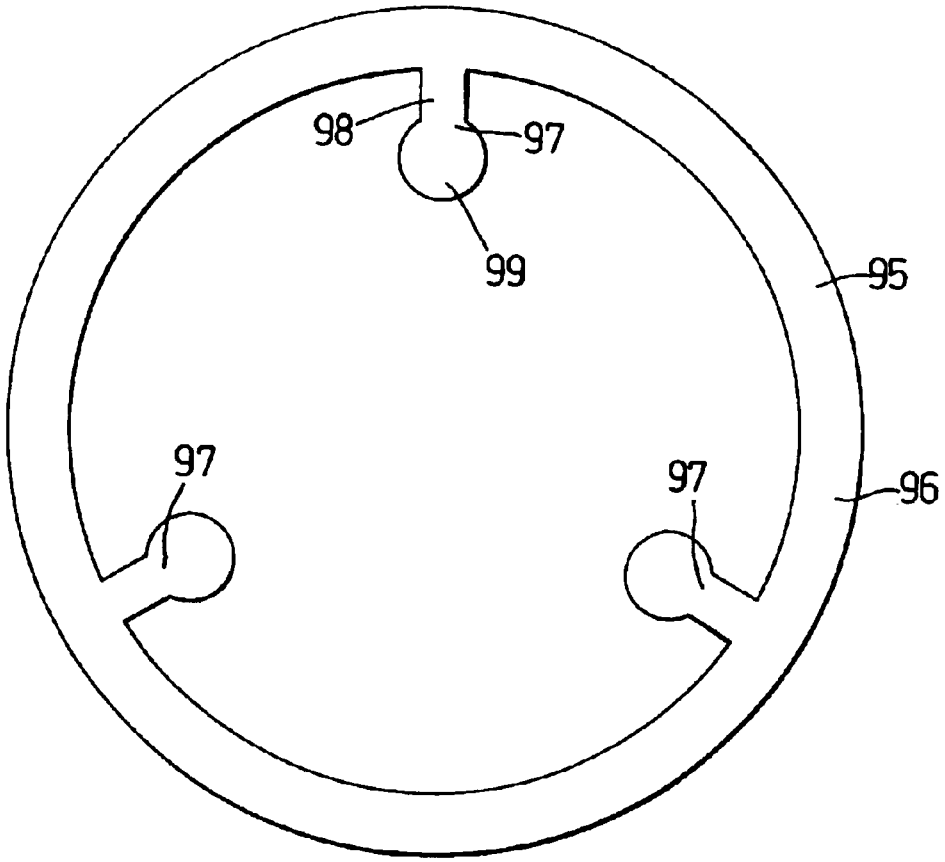
FIG. 9 is a top plan view of a detent shim forming part of a sixth embodiment of the invention.

Referring to FIG. 9, in a further modification to the first embodiment, the shim 31 is replaced by a shim 95 which has an annular portion 96 with three flexible-beams 97 equally spaced around it. Each of the beams 97 has a narrow body 98 connected to the annular portion 96 and a wider head 99. Referring also back to FIG. 3*a*, the use of three beams 97 results in centring of the paintball 22*a* as it passes through the shim 95, and also centring of the paintball 22*a* when it has passed through the shim 95 and forms the top paintball in the stack of paintballs 22*a*, 22*b*, 22*c*. This helps to ensure that the stack of paintballs 22*a*, 22*b*, 22*c* is held in line and that the beams 97 hold them completely stationary.

Figure 10:
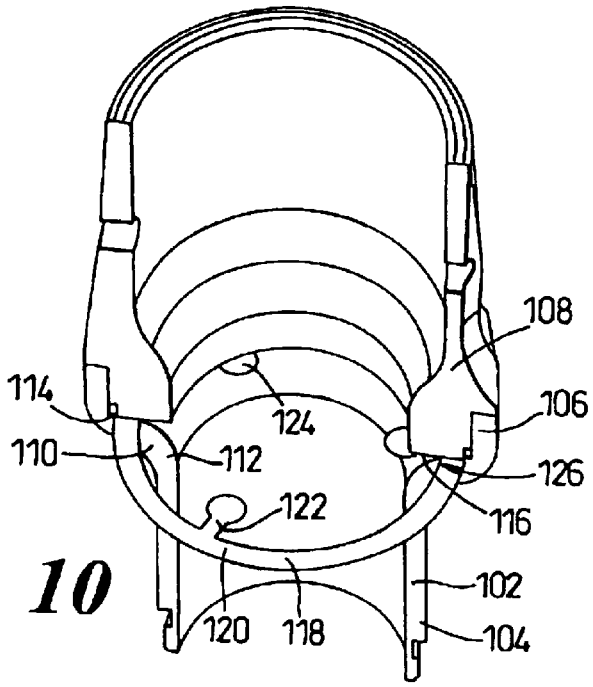
FIG. 10 is a cut-away view of a paintball feeder system according to a seventh embodiment of the invention.

Referring to FIG. 10, in a further embodiment a marker feed tube 102 has a lower portion 104 which fits onto the top of the marker, and a wider upper portion 106 with internal thread arranged to mate with the hopper feed tube 108. A shoulder 110 is formed between the upper and lower portions 106, 104 which is angled to the horizontal, its inner edge 112 being lower than its outer edge 114. The hopper feed tube 108 has a flat horizontal lower end surface 116 which is approximately as wide as the shoulder 110. A shim 118 similar to that of FIG. 9 has its annular part 120 held between the shoulder 110 and the lower end surface 116 of the hopper feed tube 108. Its three flexible beams 122 extend radially inwards between the shoulder 110 and the lower end surface 116 of the hopper feed tube 108, and have their ends 124 projecting radially inwards beyond them.

The beams 122 can therefore rest against the lower end surface 116 of the hopper feed tube, and cannot easily be bent upwards, as they have to flex about the inner edge 116*a* of that lower end surface 116. However, they can more easily bend downwards away from that lower end surface 116 and towards the sloping shoulder 110, as they can flex about a point 126 where contact between the shim 118 and the shoulder 110 stops. This embodiment therefore operates in a similar manner to the embodiments described above, with the beams 122 flexing downwards to allow paintballs to pass down from the hopper into the marker, but not preventing the paintballs from passing back up into the hopper.

Figure 11:
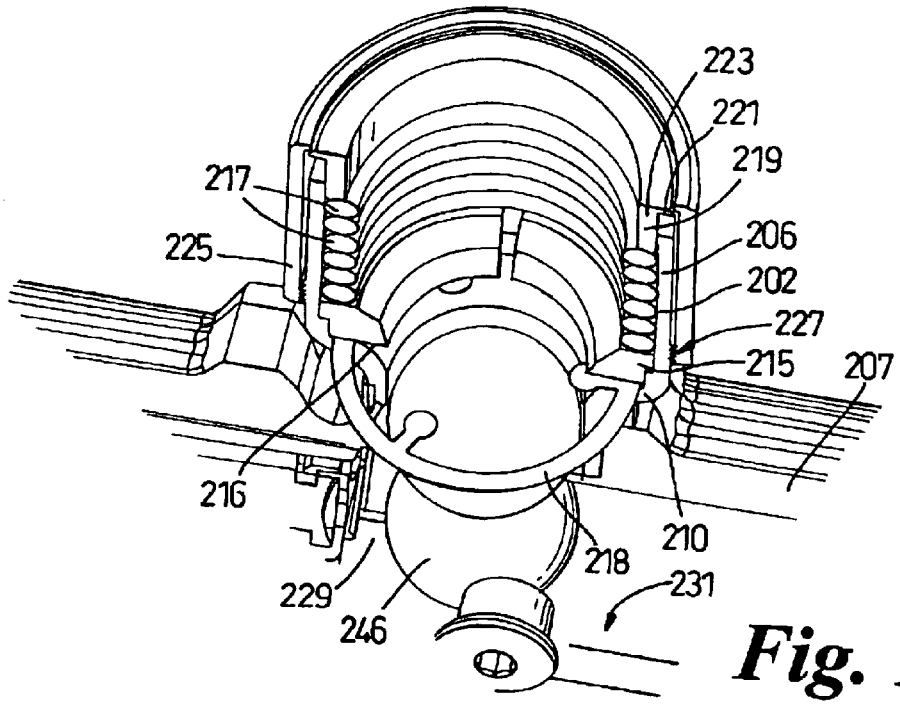
FIG. 11 is a cut-away view of a paintball feeder system according to an eighth embodiment of the invention.

Referring to FIG. 11, in a further embodiment of the invention, the marker feed tube 202 is shaped similarly to that of FIG. 10, but the shoulder 210 is lower down and the upper part 206 is longer. The shim 218 rests on the shoulder 210, but is held down on the shoulder 210 by a retaining collar 215, which has a flat horizontal lower surface 216 corresponding to that on the hopper feed tube 108 of FIG. 10. The retaining collar 215, and a stack of resiliently compressible O-rings 217 on top of the collar 215, fit inside the upper part 206 of the marker feed tube 202. A compression collar 219 rests on top of the O-rings 217 and has a flange 221 extending outwards from its upper end 223 over the top of the marker feed tube 202. An adjusting collar 225 fits around the outside of the marker feed tube 202, being engaged with it by means of screw thread 227 which allows the adjusting collar 225 to be moved up and down the marker feed tube 202 by being rotated. The top of the adjusting collar 225 engages with the compression collar 219 50 that screwing the adjusting collar 225 downwards forces the compression collar 219 downwards, compressing the O-rings 217.

The O-rings 217 form a resilient support into which the neck of a hopper, corresponding to the neck 49 of the hopper 50 of FIG. 4, can be inserted. The hopper is held in place by friction between the O-rings 217 and the hopper neck. The mechanism is adjustable to enable it to accommodate hopper necks of different diameters, the adjustment being made by screwing the adjusting collar 225 up or down the marker feed tube 202, thereby releasing or compressing the O-rings 217. Compressing the O-rings causes them to deform inwards, so that they will grip a smaller hopper neck, and releasing them allows them to expand vertically and contract horizontally, allowing a larger hopper neck to be inserted into them. In this example the system is adjustable to fit hoppers with outer neck diameters from 24 to 30 mm.

The marker feed tube 202 fits into the body 207 of the marker, and paintballs 246 pass down through it from the hopper into the breech 229. In this case the beams 222 of the shim 218 are spaced from the floor 231 of the breech 229 sufficiently to allow one paintball 246 to rest on the floor 231 of the breech and another paintball 246 to rest on top of the first, and be held against it by the beams 222.

It will be appreciated that although described as having a narrow elongate body with a circular head the detent beams may be of any convenient shape, for example rectangular, rectangular terminating in a semi-circular head or outwardly tapering.

It will be further appreciated that although the embodiments described above have two or three detent beams, the feed system may have only one detent beam or any convenient higher number of detent beams.

What is claimed is:

1. A paintball feed system for a paintball marker, the system comprising means for defining a feed channel through which paintballs can pass into the marker, flexible detent means for allowing paintballs to pass in a first direction through the feed channel into the marker, and being further arranged to prevent the passage of the paintballs in a second direction through the channel out of the marker.

2. A feed system according to claim 1 comprising support means for defining first and second support points from which the detent means is arranged to flex in the first and second directions respectively.

3. A feed system according to claim 2 wherein the detent means has a free end and the second support point is closer to the free end than the first support point.

4. A feed system according to claim 1 wherein the detent means comprises a flexible beam.

5. A feed system according to claim 4 wherein the beam has a cross-sectional area which varies along its length.

6. A feed system according to claim 5 wherein the beam has a base and a free end and the cross sectional areas increases towards the free end.

7. A feed system according to claim 6 wherein the beam has a narrow portion towards the base and a broad head portion towards the free end.

8. A feed system according to claim 1 wherein the detent means is arranged to be spaced from a floor of a breech of the paintball marker and the feed channel is arranged to receive a plurality of paintballs including an uppermost paintball which is in contact with the detent means and a lowermost paintball which is in contact with the floor of the breech whereby vertical movement of the paintballs between the detent means and the floor is inhibited.

9. A feed system according to claim 1 wherein the detent means is arranged to allow a paintball to pass in the first direction under its own weight.

10. A feed system according to claim 1 wherein the detent means comprises a plurality of flexible beams.

11. A feed system according to claim 10 wherein the detent means comprises at least three flexible beams spaced around the feed channel.

12. A feed system according to claim 10 wherein the flexible beams extend radially inwards towards the centre of the feed channel.

13. A feed system according to claim 1 including an annular shim wherein the detent means project radially inwards from the shim.

14. A feed system according to claim 1 further comprising adjustment means for adjustment of the distance between the detent means and a floor of a breech of the marker.

15. An adapter for connecting a paintball marker to a paintball storage device wherein the adapter includes a feed system according to claim 1.

16. An adapter according to claim 15 wherein the adapter is arranged to be movable relative to at least one of the marker and the storage device in order to vary the distance between the detent means and a floor of a breech of the marker.

17. A paintball marker including a paintball feed system, the feed system comprising means for defining a feed channel through which paintballs can pass into the marker, flexible detent means for allowing paintballs to pass in a first direction through the channel into the marker, and being further arranged to prevent the passage of the paintballs in a second direction through the channel out of the marker.

18. A paintball marker and hopper assembly including a paintball feed system, the feed system comprising means for defining a feed channel through which paintballs can pass from the hopper into the marker, flexible detent means for allowing paintballs to pass in a first direction through the channel from the hopper into the marker, and being further arranged to prevent the passage of the paintballs in a second direction through the channel out of the marker towards the hopper.

19. A paintball feed system for a paintball marker, the system comprising a feed channel through which paintballs can pass into the marker, a flexible detent arranged to deflect to allow paintballs to pass in a first direction through the channel into the marker, and being further arranged to prevent the passage of the paintballs in a second direction through the channel out of the marker.

20. A feed system according to claim 19 comprising first and second supports which define first and second support points from which the flexible detent is arranged to flex in the first and second directions respectively.

21. A feed system according to claim 20 wherein the flexible detent has a free end and the second support point is closer to the free end than the first support point.

22. A feed system according to claim 19 wherein the flexible detent comprises a flexible beam.

23. A feed system according to claim 22 wherein the beam has a cross-sectional area which varies along its length.

24. A feed system according to claim 23 wherein the beam has a base and a free end and the cross sectional areas increases towards the free end.

25. A feed system according to claim 24 wherein the beam has a narrow portion towards the base and a broad head portion towards the free end.

26. A feed system according to claim 19 wherein the flexible detent is arranged to be spaced from a floor of a breech of the paintball marker and the feed channel is arranged to receive a plurality of paintballs including an uppermost paintball which is in contact with the detent means and a lowermost paintball which is in contact with the floor of the breech whereby vertical movement of the paintballs between the detent means and the floor is inhibited.

27. A feed system according to claim 19 wherein the flexible detent is arranged to allow a paintball to pass in the first direction under its own weight.

28. A feed system according to claim 19 comprising at least one further detent wherein said detent and said at least one further detent are arranged to deflect to allow paintballs to pass in a first direction through the channel into the marker, and further arranged to prevent the passage of the paintballs in a second direction through the channel out of the marker.

29. A feed system according to claim 28 comprising two said further detents such that there are three detents in total, the three detents being spaced around the feed channel.

30. A feed system according to claim 29 wherein the detents comprise flexible beams arranged to extend radially inwards towards the centre of the feed channel.

31. A feed system according to claim 19 including an annular shim wherein the flexible detent projects radially inwards from the shim.

32. A feed system according to claim 19 which is adjustable to allow adjustment of the distance between the flexible detent and a floor of a breech of the marker.

33. A paintball marker feed tube assembly arranged to be mounted in a paintball marker and to support a paintball hopper having a neck, the assembly comprising a compressible member defining an aperture into which the neck can be inserted and a compression member arranged to compress the compressible member by an amount which is variable thereby to vary the size of the aperture wherein the compressible member is one of a plurality of compressible members arranged to co-operate to support the neck.

34. An assembly according to claim 33 wherein each of the compressible members comprise a ring of resilient material.

35. A paintball marker feed tube assembly arranged to be mounted in a paintball marker and to support a paintball hopper having a neck, the assembly comprising a compressible member defining an aperture into which the neck can be inserted and a compression member arranged to compress the compressible member by an amount which is variable thereby to vary the size of the aperture and further comprising a flexible detent arranged to deflect to allow paintballs to pass in a first direction through the assembly into the marker, and being further arranged to prevent the passage of the paintballs in a second direction through the assembly out of the marker, and a retaining member arranged to retain the detent in the assembly, wherein the compressible member rests on the retaining member.

* * * * *